US010355425B2

(12) United States Patent
Gustafsson

(10) Patent No.: US 10,355,425 B2
(45) Date of Patent: Jul. 16, 2019

(54) CABLE WITH ALARM

(71) Applicant: South Coast Engineering AB, Abbekås (SE)

(72) Inventor: Mattias Gustafsson, Abbekås (SE)

(73) Assignee: SCUDI AB, Skivarp (SE)

( * ) Notice: Subject to any disclaimer, the term of this patent is extended or adjusted under 35 U.S.C. 154(b) by 0 days.

(21) Appl. No.: 16/091,302

(22) PCT Filed: Apr. 7, 2017

(86) PCT No.: PCT/SE2017/050350
§ 371 (c)(1),
(2) Date: Oct. 4, 2018

(87) PCT Pub. No.: WO2017/180046
PCT Pub. Date: Oct. 19, 2017

(65) Prior Publication Data

US 2019/0123494 A1 Apr. 25, 2019

(30) Foreign Application Priority Data

Apr. 13, 2016 (SE) ..... 1650499

(51) Int. Cl.
*G08B 21/00* (2006.01)
*H01R 13/66* (2006.01)
(Continued)

(52) U.S. Cl.
CPC ..... *H01R 13/6683* (2013.01); *G08B 17/06* (2013.01); *G08B 17/10* (2013.01); *G08B 25/10* (2013.01); *H01R 2201/20* (2013.01)

(58) Field of Classification Search
None
See application file for complete search history.

(56) References Cited

U.S. PATENT DOCUMENTS 4,372,693 A * 2/1983 Lutz ..... G08B 17/06 324/519
5,418,521 A 5/1995 Read
(Continued)

FOREIGN PATENT DOCUMENTS

DE 20219524 U1 3/2003
EP 2706628 A1 3/2014
(Continued)

OTHER PUBLICATIONS

International Search Report and Written Opinion from corresponding International Application No. PCT/SE2017/050350, dated Jun. 30, 2017; 13 pages.
(Continued)

*Primary Examiner* — Julie B Lieu
(74) *Attorney, Agent, or Firm* — Tucker Ellis LLP

(57) ABSTRACT

The disclosure proposes a cable for connecting to an electronic device. The cable comprising an electrical cord, a connector, a sensor device and an alarm unit. The connector is connected to one end of the electrical cord, and adapted to connect the cable to the electronic device. The sensor device is arranged at the connector and is adapted for collecting sensor data from the electronic device when the connector is connected to the electronic device. The alarm unit is connected to the sensor device and arranged to initiate an alarm based on output data from the sensor device.

12 Claims, 3 Drawing Sheets

(51) Int. Cl.

| | |
|---|---|
| ***G08B 17/06*** | (2006.01) |
| ***G08B 17/10*** | (2006.01) |
| ***G08B 25/10*** | (2006.01) |

(56) References Cited

U.S. PATENT DOCUMENTS

| | | | | |
|---|---|---|---|---|
| 6,150,940 | A * | 11/2000 | Chapman | G08B 13/14 200/61.59 |
| 6,326,766 | B1 | 12/2001 | Small | |
| 7,808,761 | B2 | 10/2010 | O'Rourke | |
| 8,902,555 | B2 * | 12/2014 | Cheng | H01R 13/7137 361/103 |
| 8,981,731 | B1 * | 3/2015 | Oku | H02J 7/027 320/107 |
| 2008/0084216 | A1 | 4/2008 | Sanderford et al. | |
| 2008/0265677 | A1 | 10/2008 | Chiang et al. | |
| 2009/0108812 | A1 | 4/2009 | Lee | |
| 2011/0050439 | A1 | 3/2011 | Wang | |
| 2013/0278226 | A1 * | 10/2013 | Cong | H02J 7/007 320/150 |
| 2014/0191705 | A1 | 7/2014 | Takao et al. | |
| 2014/0302717 | A1 | 10/2014 | Cheng | |
| 2015/0180180 | A1 * | 6/2015 | Kim | H01R 13/7137 439/620.08 |
| 2015/0262468 | A1 | 9/2015 | Yang | |
| 2016/0056588 | A1 * | 2/2016 | Motoichi | H01R 13/7137 439/620.22 |
| 2016/0107530 | A1 * | 4/2016 | Roberts | B60L 11/1818 320/109 |
| 2017/0070090 | A1 * | 3/2017 | Miller | H02J 13/0079 |
| 2017/0093148 | A1 * | 3/2017 | Wang | H02H 5/04 |
| 2017/0334300 | A1 * | 11/2017 | Huang | H02J 7/0045 |
| 2018/0013302 | A1 * | 1/2018 | Shoari | G06F 1/203 |
| 2018/0205253 | A1 * | 7/2018 | Kwak | H02J 7/0055 |

FOREIGN PATENT DOCUMENTS

| | | | |
|---|---|---|---|
| EP | 2928024 | A1 | 10/2015 |
| EP | 2963626 | A1 | 1/2016 |
| TW | M347745 | U | 12/2008 |
| WO | 2015113666 | A2 | 8/2015 |

OTHER PUBLICATIONS

PRV Intention to Grant, from corresponding SE Application No. 1650499-5, dated Sep. 11, 2018; 21 pages.

PRV Search Report from corresponding SE Application No. 194850, dated Jan. 4, 2016; 8 pages.

PRV Office Action dated Nov. 22, 2016, from corresponding Swedish Application No. 1650499-5; 7 pages.

* cited by examiner

CABLE WITH ALARM

TECHNICAL FIELD

The disclosure pertains to the field of electronic devices, rechargeable batteries, chargers and cables for chargers. More particularly the disclosure is related to an electrical cable for charging or powering an electronic device.

BACKGROUND

Electrical cables are used for interconnecting an electronical device and a power source for powering the electronical device. Electronical devices often contain a battery that can be charged. A power source may be a charger or a mains transformer. There are many electronical devices today comprising rechargeable batteries and that are frequently connected to a charger. Today, smartphones and tablets are charged on a daily basis in most homes around the world. There are also other electronical devices, machines, and tools that run on rechargeable batteries; such as electrical hand tools (e.g. screw drivers), kitchen devices (e.g. a mixer) and toys (e.g. a radio controlled car). Larger devices such as electric lawn mowers, bikes and cars are also connected to a power source for powering and charging.

Typically a cable to interconnect a smartphone or a tablet with a power source is using a de-facto standard connector such as Apple Lightning connector or a standard connector. One standard for connectors is the Universal Serial Bus (USB) industrial standard that among other things defines power supply between electronic devices and between an electronic device and a power source.

Unfortunately it has turned out that things can go wrong during charging of electronical devices and there are several incidents were devices, batteries and chargers have caused fire that has led to injury on both humans and property. Due to the risk of fire, people have even been advised not to leave electronical devices connected to chargers unattended, especially overnight, and to consider where the items are being left whilst they are charged; e.g. if a product is charged on a flammable surface, it increases the risk of a fire spreading.

SUMMARY

An object of the present disclosure is to provide a device and a method which seek to mitigate, alleviate, or eliminate one or more of the above-identified deficiencies in the art and disadvantages singly or in any combination.

In this disclosure, a solution to the problem outlined above is proposed. In the proposed solution, a fire can be detected at an early stage in order to take actions to stop the fire from spreading or alternatively/additionally, high temperatures indicative of a fire risk can be detected.

The disclosure proposes a cable for connecting to an electronic device. The cable comprising an electrical cord, a connector, a sensor device and an alarm unit. The connector is connected to one end of the electrical cord, and adapted to connect the cable to the electronic device. The sensor device is arranged at the connector and is adapted for collecting sensor data from the electronic device when the connector is connected to the electronic device. The alarm unit is connected to the sensor device and arranged to initiate an alarm based on output data from the sensor device.

Hence, a user of the electronic device can be notified by an alarm if the sensor device collecting sensor data from the electronic device detects a fire or a high temperature, depending on the sensor device. The user can then take actions to prevent the fire from spreading or to turn the electrical device off and/or moving it to a safe location to stop the temperature from rising and hence minimize the harm on humans and property.

According to some aspects of the disclosure the cable comprising two or more sensor devices arranged at the connector. Hence plural ways to detect fire or high temperature is possible.

According to some aspects of the disclosure the sensor device is a fire sensor device. Hence the sensor device is arranged to detect fire for example by sensing heat, particles or smoke etc.

According to some aspects of the disclosure the cable is arranged for charging or powering the electronic device. This means that the cable is always connected when charging and hence collecting sensor data from the electronic device during the whole charging period. During charging the risk of fire in the electric device is higher compared when not connected.

According to some aspects of the disclosure the sensor device is any of a temperature sensor, a photo detector, a particle sensor, a current sensor, a voltage sensor, or a humidity sensor. Hence fire and/or high temperature can be detected in many different ways. One sensor device may also be used in combination with another sensor device in order to enhance detection of fire and/or high temperature.

According to some aspects of the disclosure the electrical cord further comprising a conductor adapted to transport electricity in the electrical cord when connected to an external power source and for powering the sensor device and the alarm unit. An advantage with this way of powering the sensor device and the alarm unit is that they are automatically powered when connected and hence activated only when the cable is used.

According to some aspects of the disclosure a power source is connected to the sensor device and the alarm unit for powering said sensor device and alarm unit. An advantage with this way of powering the sensor device and the alarm unit is that they can be powered even if not connected to an external power source. Another advantage is that the sensor device and the alarm unit can continue to operate even if the external power source is not functioning, e.g. due to a fire.

According to some aspects of the disclosure the power source is a capacitor arranged to be charged by power from a conductor transporting electricity in the electrical cord when connected to an external power source. A capacitor is a reliable simple way of storing electrical energy. A capacitor can hence replace a battery. A capacitor will secure that the sensor device and the alarm unit are powered without an external power source. Since the capacitor is charged by power from the conductor no additional power source is needed for charging the capacitor and the capacitor is charged every time the cable is connected to a power source.

According to some aspects of the disclosure the power source is a battery. A battery will secure that the sensor device and the alarm unit are powered without an external power source. The battery can be a rechargeable battery or a replaceable disposable battery.

According to some aspects of the disclosure the battery is arranged to be charged by power from a conductor transporting electricity in the electrical cord when connected to an external power source. Hence no additional power source is needed for charging a rechargeable battery and the battery is charged every time the cable is connected to a power source.

According to some aspects of the disclosure the alarm unit is arranged to initiate an alarm based on the sensor data when the sensor data exceeds a predetermined value or when sensor data deviates from a predetermined interval value. The different values can be chosen so that false alarms can be avoided and to only allow a certain deviation from a normal value before initiating the alarm in order to get reliable operation and a trustful interaction with the user.

According to some aspects of the disclosure the alarm initiated by the alarm unit is any of an audio, tactile or visual feedback to a user. This means that the user can get plural ways of getting notified in order to get the attention from the user. The different feedbacks can be used separately or in combination. Audio feedback may be effective to use in a quiet environment, while a tactile or visual feedback may be effective in a noisy environment or if e.g. the user has impaired hearing to get the attention of the user.

According to some aspects of the disclosure, the cable comprises a communication unit arranged to communicate wirelessly with an external electronic device and wherein the alarm initiated by the alarm unit comprises to send an alarm signal to the external electronic device. Hence an external electronic device can be used in order to get the attention of a user. The user may be in another room or away from the electronic device that is being charged and cannot hear, feel or see any of the alarms initiated by the electronic device that is being charged. The externa device however can provide similar alarms more close to the user and get the user's attention.

BRIEF DESCRIPTION OF THE DRAWINGS

The foregoing will be apparent from the following more particular description of the example embodiments, as illustrated in the accompanying drawings in which like reference characters refer to the same parts throughout the different views. The drawings are not necessarily to scale, emphasis instead being placed upon illustrating the example embodiments.

DETAILED DESCRIPTION

Figure 1:
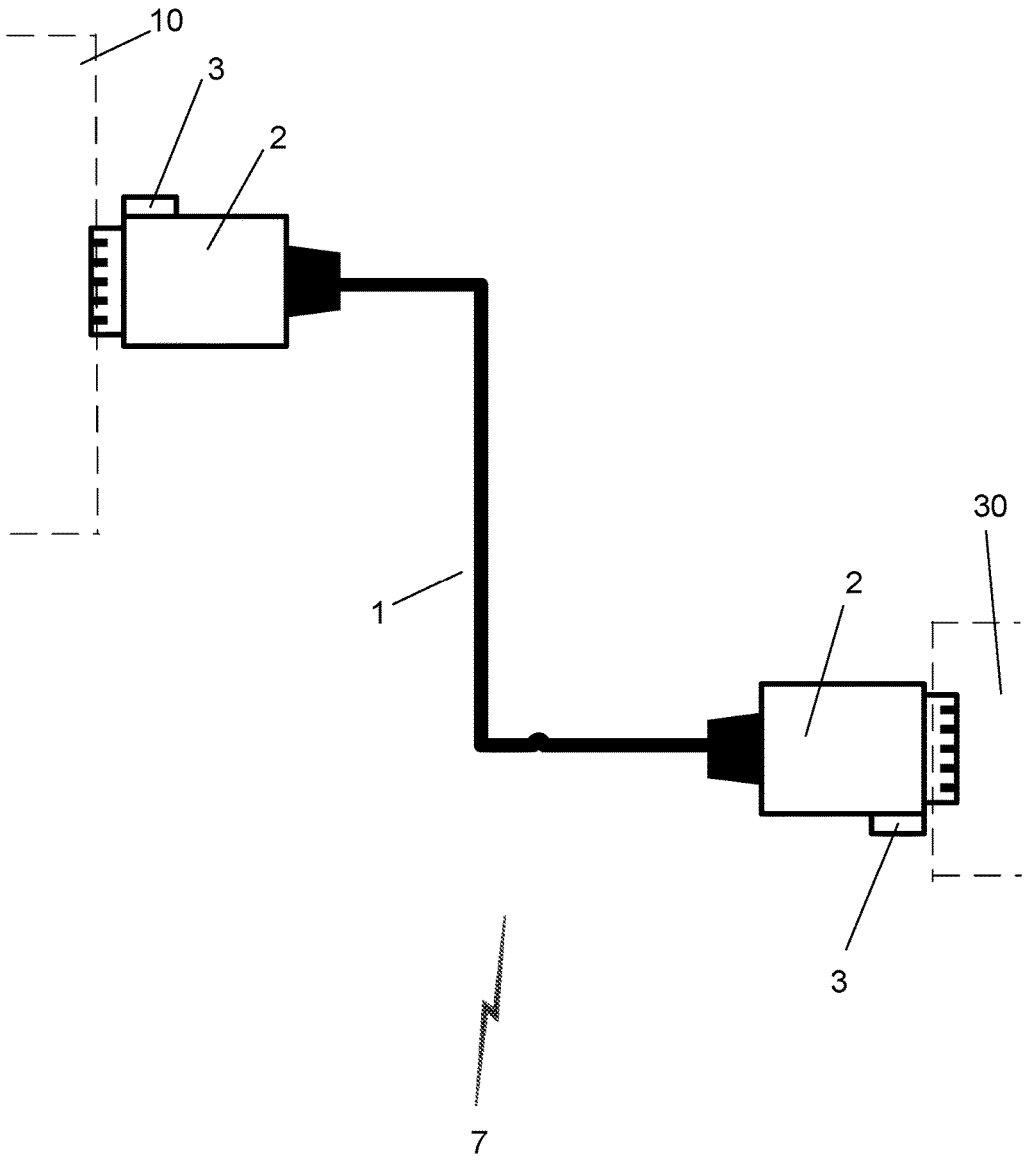
FIG. 1 illustrates a cable for charging having one connector in each end and each connector has a sensor device, one connector is connected to a power source and one connector is connected to an electronic device.
Figure 2:
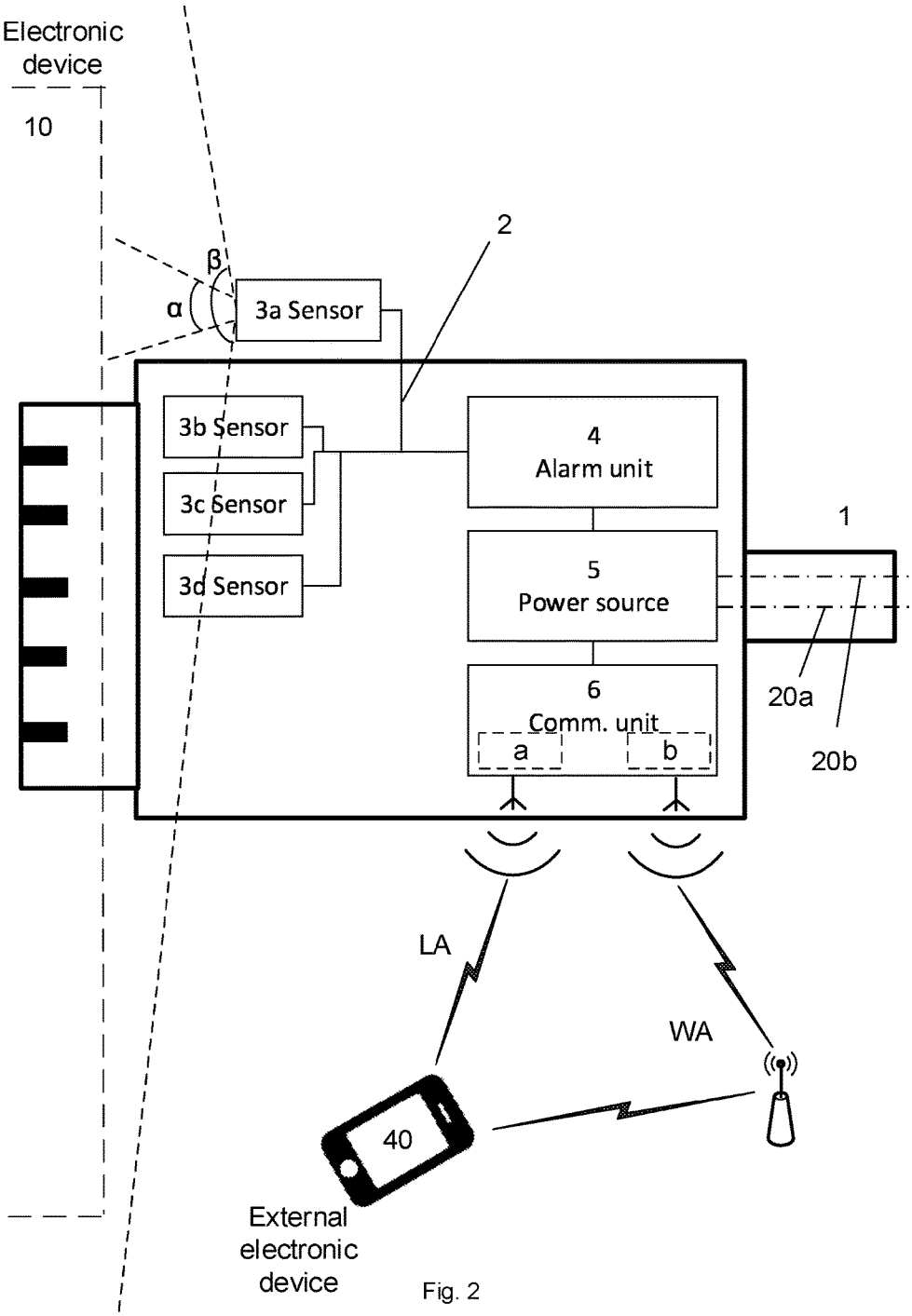
FIG. 2 illustrates a cable comprising a connector. The connector is described further in a more detailed view.
Figure 3:
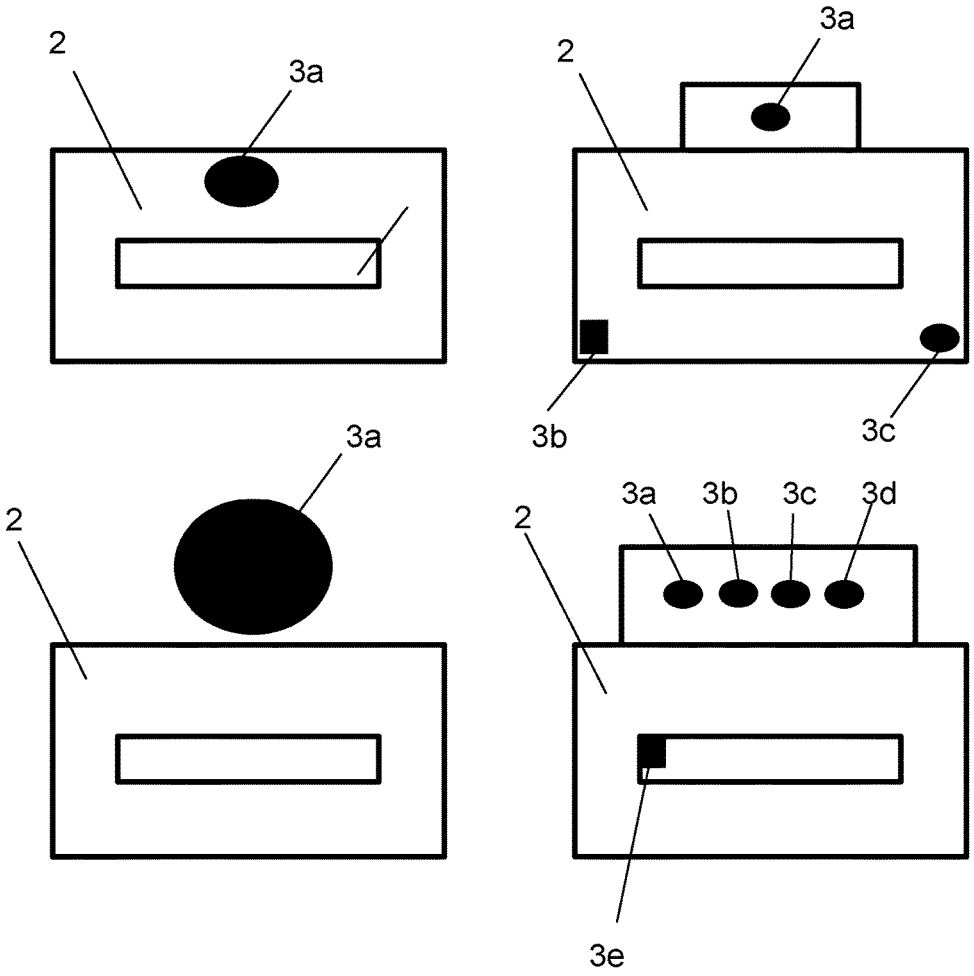
FIG. 3 illustrates different examples how sensor devices could be arranged at the connector.

Aspects of the present disclosure will be described more fully hereinafter with reference to the accompanying drawings. The apparatus and method disclosed herein can, however, be realized in many different forms and should not be construed as being limited to the aspects set forth herein. Like numbers in the drawings refer to like elements throughout.

The terminology used herein is for the purpose of describing particular aspects of the disclosure only, and is not intended to limit the disclosure. As used herein, the singular forms "a", "an" and "the" are intended to include the plural forms as well, unless the context clearly indicates otherwise.

FIG. 1 illustrates a cable 7 for charging comprising a cord 1 having one connector 2 in each end and a sensor device 3 is arranged at each connector 2 one connector 2 is connected to a power source 30 and one connector is connected to an electronic device 10. The cable 7 could also have one ordinary connector such as an ordinary USB connector and one connector 2 according to the disclosure having a sensor device 3.

The cable 7 comprising an electrical cord 1, a connector 2, a sensor device 3 and an alarm unit 4. The connector 2 is connected to one end of the electrical cord 1, and adapted to connect the cable 7 to the electronic device 10. The sensor device 3 is arranged at the connector 2 and is adapted for collecting sensor data from the electronic device 10 when the connector 2 is connected to the electronic device 10. The alarm unit 4 is connected to the sensor device 3 and arranged to initiate an alarm based on output data from the sensor device 3.

According to some aspects of the disclosure the cable 7 comprising two or more sensor devices 3 arranged at the connector 2. Hence plural ways to detect fire or high temperature is possible.

According to some aspects of the disclosure the sensor device 3 is a fire sensor device. Hence the sensor device 3 is arranged to detect fire for example by sensing heat, particles or smoke etc.

The sensor device 3 can be mounted on the connector 2 or built in the connector 2. The sensor device 3 is arranged in connection with the connector 2 so that it can collect sensor data from the electronic device 10. The sensor device 3 can detect events or changes in the environment by collecting sensor data. The sensor device 3 collects sensor data and provides an output data from the sensor device 3. The sensor data collected by the sensor device 3 is dependent on the type of sensor device 3. The output data from the sensor device 3 is dependent on the collected sensor data. According to some aspects of the disclosure collected sensor data can be a change in the temperature and the output data can be a change in an output signal or an output resistance of an electrical circuit.

In one example a sensor device 3 of the disclosure is arranged to detect heat. In other words a sensor device 3 for collecting sensor data related to temperature has to be arranged with the connector 2 so that the sensor device 3 can detect temperature in an efficient way. One possible implementation is to have a temperature sensor device 3 on the connector 2 that is facing the electronic device 10 when the connector 2 is connected to the electronic device 10. One possible implementation is to have a temperature sensor device built in the connector 2 that sense the temperature of the electronic device when it is physically connected to the connector 2.

According to some aspects of the disclosure the sensor device 3 is any of a temperature sensor, a photo detector, a particle sensor, a current sensor, a voltage sensor, or a humidity sensor. According to some aspects of the disclosure the sensor device 3 is any kind of sensor device.

According to some aspects the temperature is measured either by a temperature sensor device 3*e* in the connector itself to sense change of the temperature of the electronic device 10 when connected to the connector 2. A temperature sensor can also detect the temperature in the surrounding air. According to one aspect the temperature is measured using a camera or other photo detector as sensor device 3. Such camera or photo detector can use i.e. an infrared (IR) sensor or IR camera. In order to collect sensor data that is related to the electronic device 10 the sensor device 3 is facing the electronic device 10. In one example the sensor device has an adjustable viewing angle ($\alpha$,$\beta$). According to an aspect the viewing angle of the sensor device 3 can be adjusted when the sensor device 3 is a camera or photodetector. This is illustrated in FIG. 1 with the viewing angles $\alpha$ and $\beta$. In this way the viewing angle can be adopted to only collect sensor data from the electronic device 10 (viewing angle α) or the viewing angle can be adopted to also collect sensor data from other objects around the electronic device 10 (viewing angle β).

The temperature sensor device 3 can also be a thermistor that changes resistance dependent on the temperature. Such sensor device 3 is of low cost and simple in construction but reliable for measuring temperature. According to an aspect the sensor device 3 is or comprises a Negative Temperature Coefficient (NTC) thermistor.

The sensor device 3 can also be a particle sensor that can detect smoke in the surrounding air. The charging of the electronic device 10 can be monitored by a sensor device in form of a current sensor or voltage sensor to sense change of current or voltage of either the electronic device or the power source. For example if there is a shortcircuit there is a risk for a fire or overheating. A current sensor or voltage sensor that detects exceptional change of current or voltage can hence be used to initiate the alarm.

The sensor device 3 is in one example a humidity sensor that detects the moisture content in the air. According to an aspect wet air may be a risk for the operation of the electronics in the electronic device 10 which could lead to e.g. shortcircuit and hence overheating/fire.

With sensors devices 3 as described above, fire and/or high temperature can be detected in many different ways. One sensor device 3 may also be used in combination with another sensor device 3 in order to enhance detection of fire and/or high temperature. Multiple sensor devices (3*a*, 3*b*, 3*c*, 3*d*, 3*e*) can be used in combination and can be different type of sensor devices 3. According to some aspects of the disclosure a combination of a sensor device 3 that is a temperature sensor and a sensor device 3 that is a particle sensor can be used. According to some aspects of the disclosure the electronical cord 1 comprising two connectors 2, two sensor devices 3 that are infrared (IR) sensor devices and two sensor devices 3 that are Negative Temperature Coefficient (NTC) thermistors.

Hence, a user of the electronic device 10 can be notified by an alarm if the sensor device 3 monitoring the electronic device 10 detects a fire or a high temperature, depending on the sensor device 3. The user can then take actions to prevent the fire from spreading or to turn the electrical device 10 off and moving it to a safe location to stop the temperature from rising and hence minimize the harm on humans and property.

According to some aspects of the disclosure the electrical cable 7 is arranged for charging or powering the electronic device 10. This means that the cable 7 is always connected when charging and hence collecting sensor data from the electric device 10 during the whole charging period. During charging the risk of fire in the electric device 10 is higher compared when not connected.

According to some aspects of the disclosure the electrical cord 1 further comprising a conductor 20 adapted to transport electricity in the electrical cord 1 when connected to an external power source 30 and for powering the sensor device 3 and the alarm unit 4. An advantage with this way of powering the sensor device 3 and the alarm unit 4 is that they are automatically powered when connected and hence activated only when the cable is used.

According to some aspects of the disclosure a power source 5 is connected to the sensor device 3 and the alarm unit 4 for powering said sensor device 3 and alarm unit 4. An advantage with this way of powering the sensor device 3 and the alarm unit 4 is that they can be powered even if not connected to an external power source 30. Another advantage is that the sensor device 3 and the alarm unit 4 can continue to operate even if the external power source 30 is not functioning, e.g. due to a fire.

According to some aspects of the disclosure the power source 5 is a capacitor arranged to be charged by power from a conductor 20*a*, 20*b* transporting electricity in the electrical cord 1 when connected to an external power source 30. A capacitor is a reliable simple way of storing electrical energy. A capacitor can hence replace a battery. A capacitor will secure that the sensor device 3 and the alarm unit 4 are powered without an external power source 30. Since the capacitor is charged by power from the conductor 20*a*, 20*b* no additional power source is needed for charging the capacitor and the capacitor is charged every time the cord is connected to a power source. The capacitor can be charged by an external power source 30 or by an electronic device 10.

An external power source 30 can also be another electronic device 10. When two electronical devices are interconnected with the electrical cable 7, one electronical device can be charged by power from the other electronical device. For example a cellular phone such as a smartphone can be connected to a computer such as a laptop via the cable 7.

According to some aspects of the disclosure the power source 5 is a battery. A battery will secure that the sensor device 3 and the alarm unit 4 are powered without an external power source 30. The battery can be a rechargeable battery or a replaceable disposable battery. In one example the battery can be charged by a separate power source using e.g. a micro USB connector. In one example the cable 7 comprising one connector 2 with a sensor device 3 at one end of the cord 1 and a further connector 2 with a power source 5 at the other end of the cord 1. According to some aspects of the disclosure the cable 7 comprising one connector 2 with a sensor device 3 at one end of the cord 1, the cord is connected to an external power source 30 at the other end of the cord 1.

According to some aspects of the disclosure the battery is arranged to be charged by power from a conductor 20*a*, 20*b* transporting electricity in the electrical cord 1 when connected to an external power source 30. Hence no additional power source is needed for charging a rechargeable battery and the battery is charged every time the cable 7 is connected to a power source. The capacitor can be charged by an external power source 30 or by an electronic device 10.

According to some aspects of the disclosure the alarm 5 unit is arranged to initiate an alarm based on the sensor data when the sensor data exceeds a predetermined value or when sensor data deviates from a predetermined interval value. In one example the sensor data is allowed in a certain interval, e.g. a maximum and minimum voltage but else the alarm unit 4 initiates an alarm. The different values can be chosen so that false alarms can be avoided and to only allow a certain deviation from a normal value before initiating the alarm in order to get reliable operation and a trustful interaction with the user. In one possible implementation a memory is used to store collected sensor data. For example a memory can be used in order to calculate a deviation or to store data for comparing sensor data with a predetermined value.

The alarm unit 4 comprises means for any of an audio, tactile or visual feedback to a user. According to some aspects of the disclosure the alarm initiated by the alarm unit 5 is any of an audio, tactile or visual feedback to a user. This means that the user can get plural ways of getting notified in order to get the attention from the user. The different feedbacks can be used separately or in combination. Audio feedback can be effective to use in a quiet environment, while a tactile or visual feedback may be effective in a noisy environment or if e.g. the user has impaired hearing to get the attention of the user. The audio feedback is in one example as loud as in an ordinary fire detector. The audio feedback may be sound from any of a loudspeaker, high frequency buzzer or similar.

The visual feedback is in one example a blinking light emitting diode (LED). The LED can be a multi-coloured light emitting diode (LED). Such multi-coloured light emitting diode (LED) can in one example signal green when the temperature of the electronic device 10 is normal and flash red if the temperature of the electronic device 10 is too high i.e. when the sensor data exceeds a predetermined value or when sensor data deviates from a predetermined interval value. The visual feedback is in one example a display displaying a message to a user.

According to some aspects of the disclosure, the electrical cable 7 comprises a communication unit 6 arranged to communicate wirelessly with an external electronic device 40 and wherein the alarm initiated by the alarm unit 5 comprises to send an alarm signal to the external electronic device 40. Hence an external electronic device 40 can be used in order to get the attention of a user. The user may be in another room or away from the electronic device that is being charged and cannot hear, feel or see any of the alarms initiated by the electronic device that is being charged. The externa device 40 however can provide similar alarms more close to the user and get the user's attention.

According to some aspects of the disclosure, the electrical cable 7 comprises a communication unit 6 that is adapted to communicate wirelessly using a local area (LA) connectivity radio communication interface (6*a*) For example a local area (LA) connectivity radio communication interface (6*a*) is a using a standard such as a Wireless Local Area Network (WLAN) IEEE 802.x standard, a Bluetooth or Bluetooth Low Energy (BLE) standard, a Zigbee standard, an Ultra-wideband (UWB) standard, a Radio-frequency identification (RFID) standard, a Near field communication (NFC) standard, or any other local area communication standard.

According to some aspects of the disclosure, the electrical cable 7 comprises a communication unit 6 that is adapted to communicate wirelessly using a wide area (WA) radio communication interface (6*b*). For example a wide are (WA) radio communication interface (6*b*) is a cellular network using a standard such as a Global System for Mobile Communications (GSM) standard, a Universal Mobile Telecommunications System (UMTS) standards, a Long Term Evolution (LTE) standard, or any other wide area communication standard.

The use of a local area (LA) connectivity radio communication interface (6*a*) and/or a wide area (WA) radio communication interface (6*b*), makes is possible for a user to be notified of an alarm even if the user is not close enough to hear, see or feel the alarm that is initiated by the alarm unit 4 in the connector alone. Instead, or in addition, an alarm signal is sent to the external electronic device 40. The alarm signal is then used to initiate an alarm on the external electronic device (40). The alarm on the external electronic device 40 is any of an audio, tactile or visual feedback alarm.

According to some aspects of the disclosure the electrical cable 7 comprises a further connector 2 at the other end of the electrical cord 1. In one example the further connector 2 at the other end of the electrical cord 1 comprising a further sensor 3 for collecting sensor data. In one example the further connector 2 is adapted to collect data from the electronic device 10 and/or to monitor the power source 30.

According to some aspects of the disclosure the electrical cable 7 has a connector that is any of a USB connector, a micro USB connector, an Apple Lightning connector or any connector for connecting to an electronic device 10.

In some implementations and according to some aspects of the disclosure, the functions or steps noted in the blocks can occur out of the order noted in the operational illustrations. For example, two blocks shown in succession can in fact be executed substantially concurrently or the blocks can sometimes be executed in the reverse order, depending upon the functionality/acts involved.

In the drawings and specification, there have been disclosed exemplary aspects of the disclosure. However, many variations and modifications can be made to these aspects without substantially departing from the principles of the present disclosure. Thus, the disclosure should be regarded as illustrative rather than restrictive, and not as being limited to the particular aspects discussed above. Accordingly, although specific terms are employed, they are used in a generic and descriptive sense only and not for purposes of limitation.

It should be noted that the word "comprising" does not necessarily exclude the presence of other elements or steps than those listed and the words "a" or "an" preceding an element do not exclude the presence of a plurality of such elements. It should further be noted that any reference signs do not limit the scope of the claims, that the example embodiments may be implemented at least in part by means of both hardware and software, and that several "means", "units" or "devices" may be represented by the same item of hardware.

In the drawings and specification, there have been disclosed exemplary embodiments. However, many variations and modifications can be made to these embodiments. Accordingly, although specific terms are employed, they are used in a generic and descriptive sense only and not for purposes of limitation, the scope of the embodiments being defined by the following claims.

The invention claimed is:

1. A cable for connecting to an electronic device, the cable comprising:

an electrical cord, a connector, a sensor device and an alarm unit, wherein the connector is connected to one end of the electrical cord, and adapted to connect the cable to the electronic device, the sensor device is a photo detector using an infrared sensor arranged at the connector so that the sensor device is facing the electronic device and is adapted for collecting sensor data from the electronic device when the connector is connected to the electronic device for detecting temperature and the alarm unit is connected to the sensor device and arranged to initiate an alarm based on output data from the sensor device.

2. The cable according to claim 1, wherein the cable comprising two or more sensor devices arranged at the connector.

3. The cable according to claim 1, wherein the sensor device is a fire sensor device.

4. The cable according to claim 1, wherein the cable is arranged for charging or powering the electronic device.

5. The cable according to claim 1, wherein the electrical cord further comprising a conductor adapted to transport electricity in the electrical cord when connected to an external power source and for powering the sensor device and the alarm unit.

6. The cable according to claim 1, further comprising a power source connected to the sensor device and the alarm unit for powering said sensor device and alarm unit.

7. The cable according to claim 6, wherein the power source is a capacitor arranged to be charged by power from the conductor transporting electricity in the electrical cord when connected to an external power source.

8. The cable according to claim 6, wherein the power source is a battery.

9. The cable according to claim 8, wherein the battery is arranged to be charged by power from the conductor transporting electricity in the electrical cord when connected to an external power source.

10. The cable according to claim 1, wherein the alarm unit is arranged to initiate an alarm based on the sensor data when the sensor data exceeds a predetermined value or when the sensor data deviates from a predetermined interval value.

11. The cable according to claim 1, wherein the alarm initiated by the alarm unit is any of an audio, tactile or visual feedback to a user.

12. The cable according to claim 1, further comprising a communication unit arranged to communicate wirelessly with an external electronic device and wherein the alarm initiated by the alarm unit comprises to send an alarm signal to the external electronic device.

* * * * *